US009011046B2

(12) United States Patent
Lajugie et al.

(10) Patent No.: US 9,011,046 B2
(45) Date of Patent: Apr. 21, 2015

(54) RETRACTABLE CHAIN CONNECTOR

(75) Inventors: Ioannis Mikis Lajugie, Nice (FR); Jean-Baptiste Yves Hames, Nice (FR); Sébastien Jean-François Truchi, Nice (FR)

(73) Assignee: Single Buoy Moorings Inc., Marly (CH)

( * ) Notice: Subject to any disclaimer, the term of this patent is extended or adjusted under 35 U.S.C. 154(b) by 36 days.

(21) Appl. No.: 13/825,556

(22) PCT Filed: Sep. 23, 2011

(86) PCT No.: PCT/EP2011/066609
§ 371 (c)(1), (2), (4) Date: May 9, 2013

(87) PCT Pub. No.: WO2012/038539
PCT Pub. Date: Mar. 29, 2012

(65) Prior Publication Data

US 2013/0223937 A1 Aug. 29, 2013

(30) Foreign Application Priority Data

Sep. 23, 2010 (EP) ..... 10178963

(51) Int. Cl.
*B63B 21/50* (2006.01)

(52) U.S. Cl.
CPC ..... *B63B 21/50* (2013.01); *B63B 21/507* (2013.01)

(58) Field of Classification Search
CPC ..... B63B 21/50; B63B 21/502; B63B 21/507
USPC ..... 405/224, 224.2, 224.3, 224.4; 114/230.12, 293
See application file for complete search history.

(56) References Cited

U.S. PATENT DOCUMENTS

| | | | | |
|---|---|---|---|---|
| 3,602,175 | A | 8/1971 | Morgan et al. | |
| 3,620,181 | A * | 11/1971 | Naczkowski | 114/293 |
| 5,823,131 | A | 10/1998 | Boatman et al. | |
| 5,845,893 | A * | 12/1998 | Groves | 114/293 |
| 6,663,320 | B1 * | 12/2003 | Braud et al. | 405/224 |
| 6,925,890 | B2 * | 8/2005 | Fontenot | 73/828 |
| 6,990,917 | B2 * | 1/2006 | Boatman et al. | 114/230.12 |
| 7,104,214 | B2 * | 9/2006 | Niebur | 114/293 |
| 7,325,508 | B2 * | 2/2008 | Boatman et al. | 114/293 |
| 7,421,967 | B1 | 9/2008 | Fontenot | |
| 7,926,436 | B2 * | 4/2011 | Boatman et al. | 114/230.2 |
| 2003/0121465 | A1 * | 7/2003 | Boatman et al. | 114/230.12 |
| 2006/0213418 | A1 | 9/2006 | Boatman et al. | |
| 2008/0166936 | A1 | 7/2008 | Lindblade | |

FOREIGN PATENT DOCUMENTS

| | | |
|---|---|---|
| EP | 2 154 059 | 2/2010 |
| GB | 2 351 058 | 12/2000 |
| WO | 99/17983 | 4/1999 |
| WO | 00/78599 | 12/2000 |

OTHER PUBLICATIONS

International Search Report dated Mar. 15, 2012, corresponding to PCT/EP2011/066609.

* cited by examiner

*Primary Examiner* — Frederick L Lagman
(74) *Attorney, Agent, or Firm* — Young & Thompson

(57) ABSTRACT

A mooring leg connector for use with a mooring leg (3) that has an upper portion with an axis, where the mooring leg (3) extends up from the sea floor, to connect a floating body (1) to the seabed. The mooring leg connector includes one part (20) fixed with regard to the floating body (1) and another part (30) which is movable with regard to the fixed part (20) from a first position to a second position. An offshore construction including such a mooring leg connector and a method to retract such a mooring leg connector when disconnected, are also described.

11 Claims, 5 Drawing Sheets

RETRACTABLE CHAIN CONNECTOR

FIELD OF THE INVENTION

The invention relates to a mooring leg connector for use with a mooring leg that has an upper portion with an axis, where the mooring leg extends up from the sea floor, to connect a floating body to the seabed. The invention further relates to an offshore construction comprising such a connector and a method to retract such a connector when disconnected.

BACKGROUND OF THE INVENTION

Such an offshore construction is known from WO 00/78599 in which a mooring buoy is disclosed which is anchored to the seabed in which the anchor chains are attached to the buoy via a pivoting chain receiving tube comprising a chain stopper by which the chain can be tensioned. By providing two orthogonal pivot axes for the chain tensioner, chain wear can be reduced and the tension in the chain upon movement of the buoy is decreased.

As is known generally, floating devices such as vessels or floating offshore structure, for example in the oil and gas industry, are moored to the seabed with one or more mooring lines. The floating device is kept on location because of the catenary effect of the mooring chains. A shift of the floating device leads to a lifting or lowering of the mooring chains, which leads to a counter effect striving to re-establish the original position of the floating device. The floating device is provided with a mooring chain connector assembly for each mooring chain, wherein the first pivot axis allows motions of the mooring chain in its catenary plane (so-called "in-plane motions"). It is also known to provide a second pivot axis, typically perpendicular to the first pivot axis, which second axis allows motions of the mooring chains in a transverse direction (so-called "out-of-plane motions"). In this manner fatigue problems in the mooring chain related to any motions of the mooring chain are minimized.

Mooring chain connector assemblies of this type are described for example in U.S. Pat. No. 6,663,320 filed by the applicant.

In the known mooring chain connector assemblies, the chain connector chain connector consists of articulations and a long lever arm to follow the mooring lines movements. That long lever arm hanging below the chain table requires a lot a space which is not available in dry dock or at quay side. The sea fastening is also a concern due to the high current and inertia loads acting on the lever arm.

The present invention provides a solution where the chain connector will no longer hang below the chain table when there is no space available nor while sailing without the need to move the whole chain connector from a first location to a second location above water level as described in EP2154059.

According to the present invention, the operation required, to avoid having neither the chain connector hanging when there is no space available nor while sailing, is eased and not time consuming. The solution proposed removes the critical path of installation operation, it renders the connectors easier to handle and hence the relocation of a floating unit is eased.

Further according to the present invention, the chain is protected against corrosion and the sling arrangement is simplified.

SUMMARY OF THE INVENTION

The object of the present invention is to provide mooring leg connector for use with a mooring leg that has an upper portion with an axis, where the mooring leg extends up from the sea floor, to connect a floating body to the seabed, said connector comprising:

one part fixed with regards to the floating body and another part which is movable with regards to the fixed part from a first position to a second position.

It is a further object of the present invention to provide a connector with a fixed part comprising a ratchet, a double articulation assembly having two mutually perpendicular pivot axes and a housing and with a movable part comprising an elongate tubular member extending in the anchor line direction.

According to the present invention, the elongate tubular member is retractable with regard to the fixed part from a first position where the housing is located at the top of the elongate tubular member to a second position where the housing is located at the bottom of the elongate tubular member.

Another advantage of the mooring leg connector according to the present invention is that the movable part is provided with cathodic protections against the corrosion, fitted inside the movable part itself.

A further advantage of the mooring leg connector according to the present invention is that the ratchet is provided with a counterweight to maintain the ratchet open when the connector is not connected to a mooring leg.

It is a further object of the present invention to provide an offshore construction comprising a floating body, at least one anchor line for connecting the floating body to the sea bed, the anchor line being connected to the floating body via a connector according to the present invention.

Another object of the present invention is to provide a diverless method to retract a mooring leg connector according to any one of the preceding claims, the method comprising the steps of:

lowering a pick up line through the connector elongate member picking up the line with a ROV (remotely operated underwater vehicle)

connecting the line to a centering and stabilizing means pulling the pick-up line such that the centering and stabilizing means contacts the connector retracting the movable part of the connector by further pulling on the pick-up line.

BRIEF DESCRIPTION OF THE DRAWINGS

The invention will be further described below in connection with exemplary embodiments with reference to the accompanying drawings, wherein

FIG. 1 schematically shows a FPSO vessel 1 or floating body, comprising a turret 2, which is anchored to the seabed by means of a plurality of mooring lines 3 in a usual manner.

The FPSO vessel 1 is adapted to weathervane around the turret 2. It is noted that the wording mooring chain and mooring line as used in the specification and claims may be any type of mooring means such as chains, wires, a combination thereof or the like. Each mooring line 3 is connected to the turret 2 by means of a mooring chain connector assembly 4 having two mainly perpendicular pivot axes to accommodate motions of the mooring line in its catenary plane (in-plane motions) and transverse to this plane (out-of-plane motions). In this manner fatigue problems which may lead to failure of the line are minimized.

Figure 1:
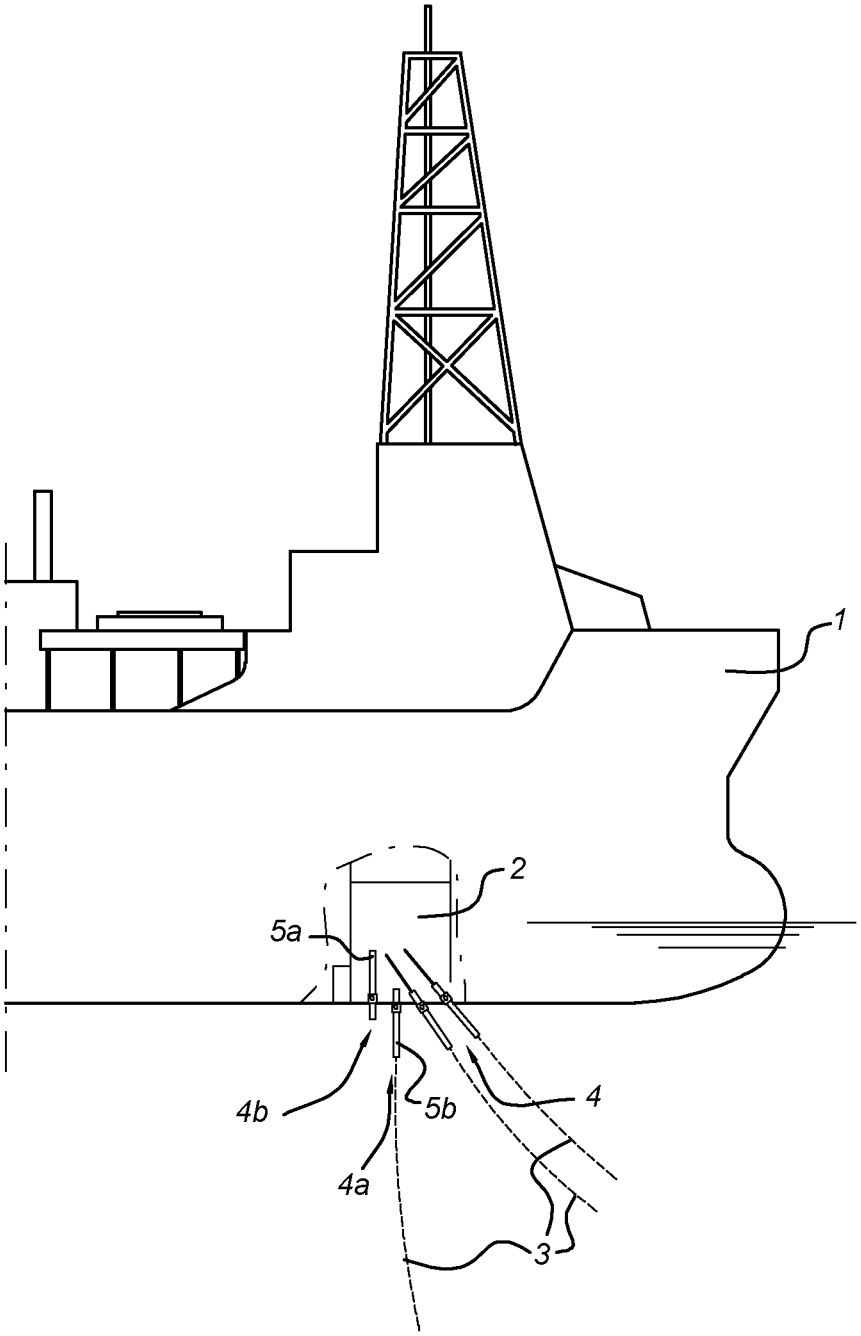
FIG. 1 shows an offshore construction comprising chain connectors according to the present invention with some connectors which are in a retracted position and others which are not.

The mooring chain connector assembly 4 is shown at a larger scale in FIGS. 2, 3*a* and 3*b* and 4. In FIG. 1 one disconnected connector 4*a* is shown. Once disconnected, the chain connector 4*a* has been retracted. Therefore in comparison with the connected chain connector 4*b*, the main part of the connector tubular body 5*a* of the connector 4*a* is within the turret 2 whereas the main part of the connector tubular body 5*b* of the connector 4*b* is below the hull of the vessel 1.

Figure 2:
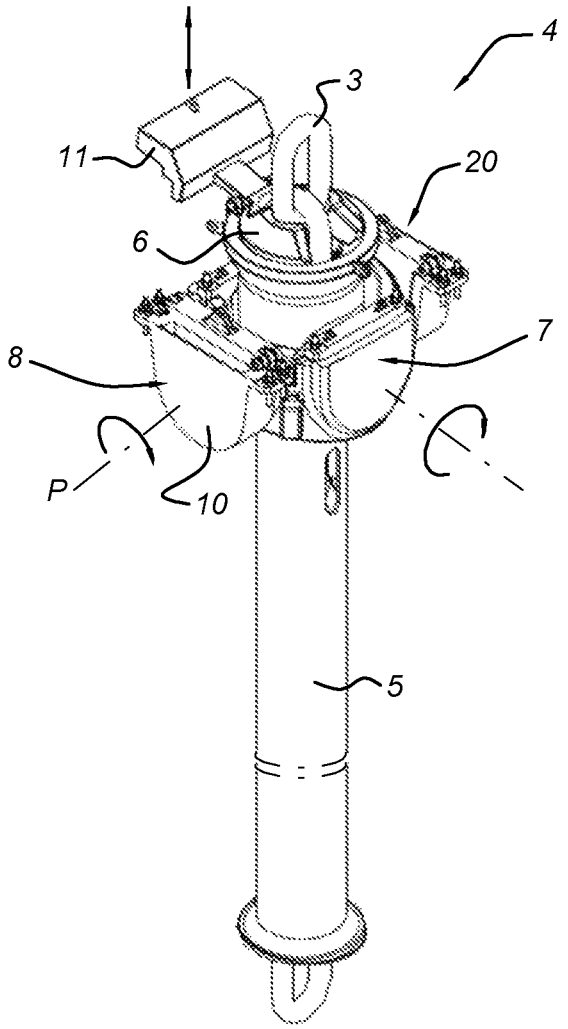
FIG. 2 shows an overview of a connector according to the present invention.

FIG. 2 shows an overview of a connector according to the present invention. The chain connector 4 is part of the FPSO mooring system. The chain is stopped by a ratchet 6 which lies on the roll body 7. The roll body 'rolls' inside the pitch body 8 which 'pitches' inside the roll blocks 9, by means of trunnions. The roll blocks 9 are mounted inside the housing 10. These housings are mounted into the chain table castings (not shown) with an intermediate resin layer to level out the chain table fabrication offsets. When the chain is not stopped by the chain connector, the ratchet 6 stays at opened position by means of a counterweight 11 and can be closed by means of a vertical chain winch (not shown).

Figure 3A:
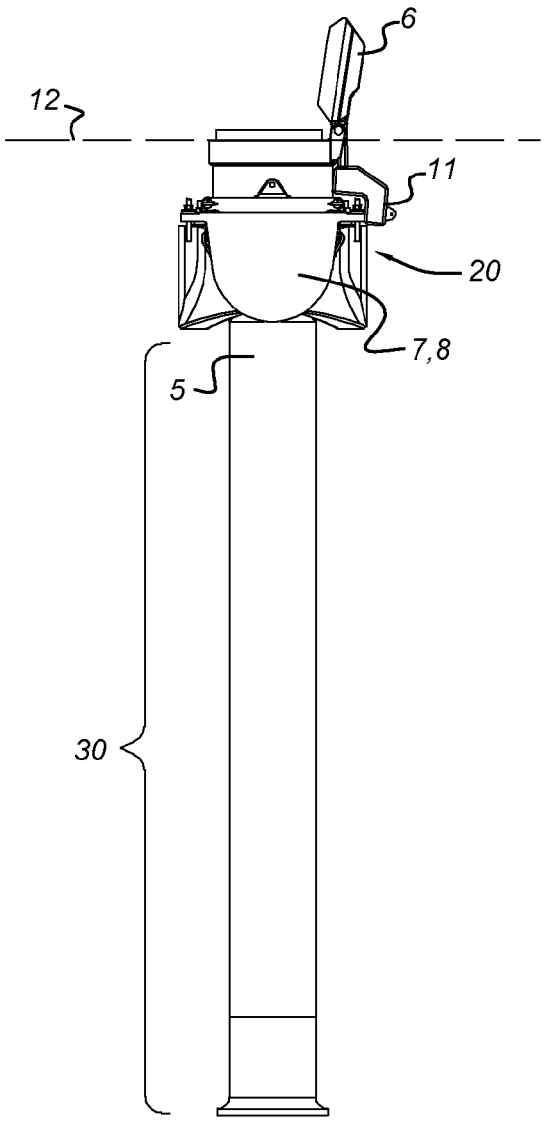
FIGS. 3*a* and 3*b* show side view of a connector according to one possible embodiment of the present invention when the movable part is not retracted and when the movable part is retracted.
Figure 3B:
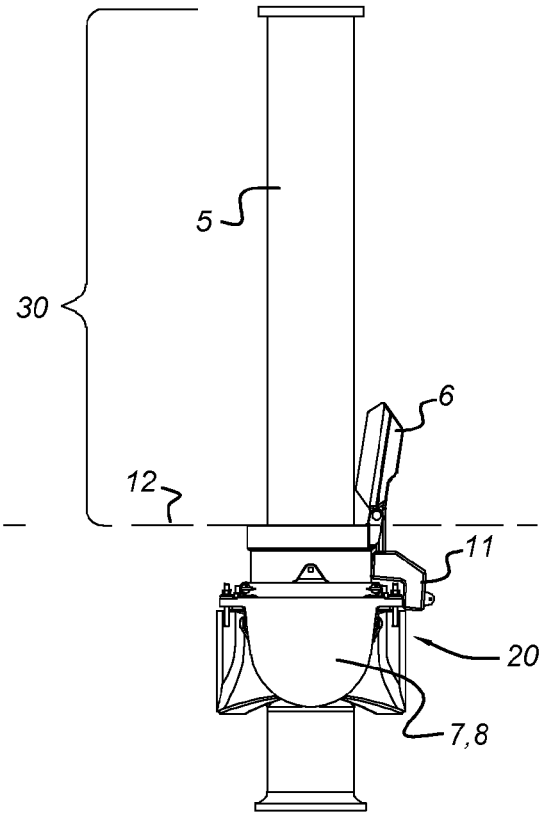

FIGS. 3*a* and 3*b* show side views of a connector according to one possible embodiment of the present invention when not retracted and when retracted. In FIGS. 3*a* and 3*b* it appears clearly that the part 20 comprising the ratchet 6 and counterweight 11, the double articulation assembly 7, 8 having two mutually perpendicular pivot axes and a housing 10 is fixed with regard to the floating body 1 whereas the part 30 comprising the elongate tubular member 5 extending in the anchor line direction is movable with regard to the floating body 1 (represented by the axis 12).

In a further embodiment, the movable part 30 is designed in such a way that the moveable part 30 is completely removable from the fixed part 20.

Figure 3C:
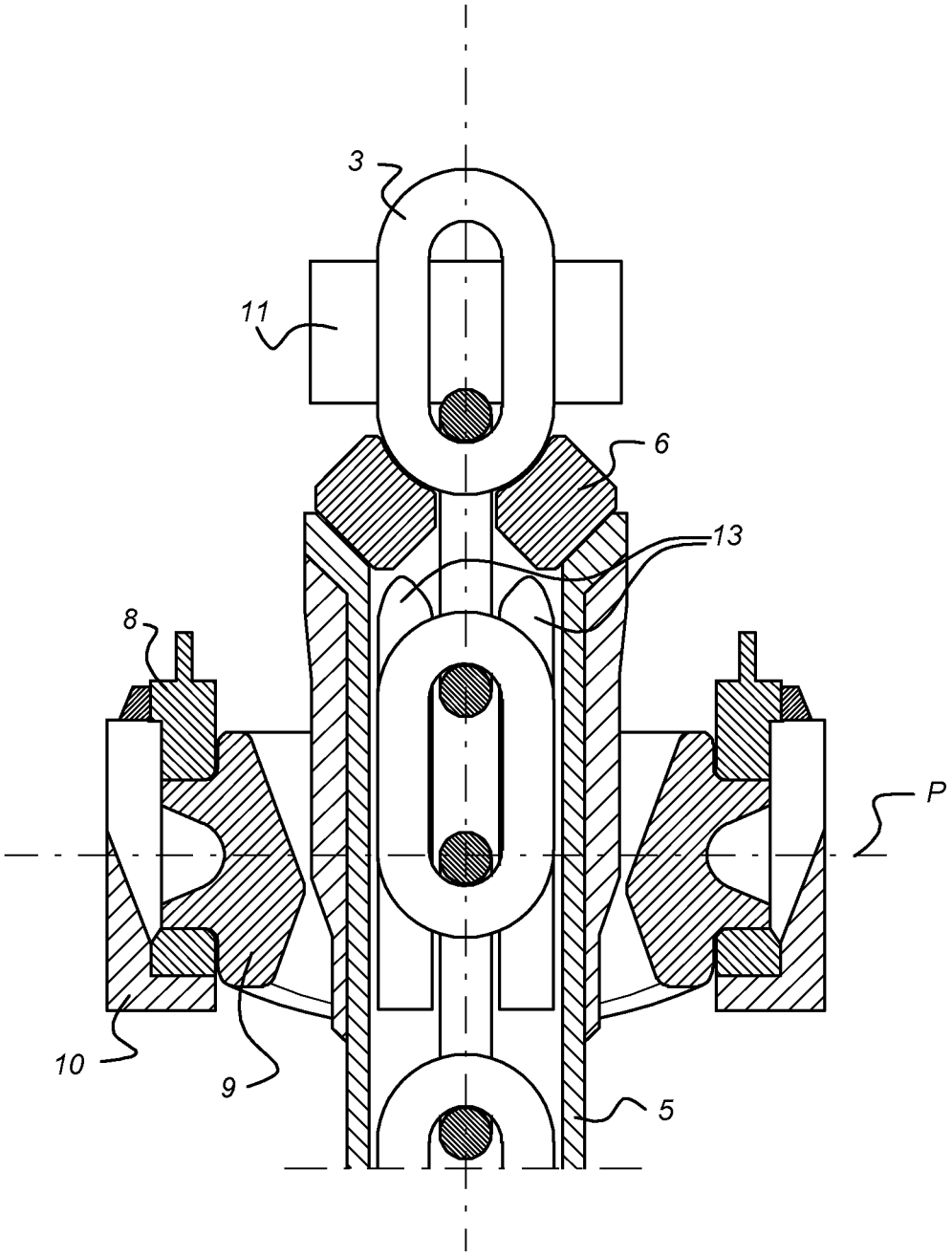
FIG. 3*c* shows a cross section of the connector of FIG. 3*a*, 3*b*, when the moveable part is not retracted.

In FIG. 3*c*, a cross-section of a chain connector according to the present invention is shown. The moveable part 30 is positioned in its extended (not retracted) position below the fixed part 20 as in FIG. 3*a*. The chain 3 is shown locked by the ratchet 6, while the counterweight 11 is held in upper position. The ratchet 6 is seated on the upper part of the roll body 7. The roll body 7 is pivotably connected to the roll block 9 by a hinge (not shown) with pivot axis perpendicular to the plane of the drawing.

The roll block 9 is pivotably connected by trunnions to the pitch body 8 with pivot axis as indicated by dashed line P. Further it is shown that the trunnions are positioned within the housing 10.

Figure 4:
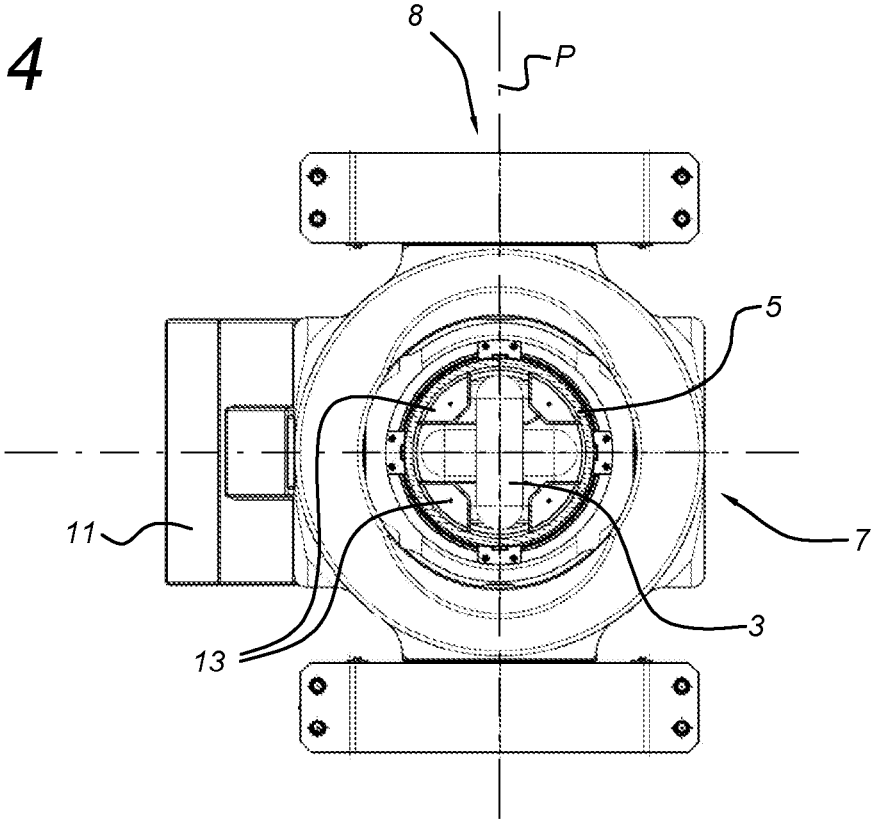
FIG. 4 shows a top view of a connector according to the present invention.

FIG. 4 shows a top view of a connector according to the present invention. In FIG. 4 it is clearly shown that the cathodic protections 13 are placed inside the elongate tubular member 5. This configuration enables to have the protections closer to the links of the chain 3 and hence better protect the chain 3 against the corrosion in order to improve the fatigue life. Further, spaces created inside the tubular member 5 to receive the cathodic protections 13 are also as means for positioning and maintaining the chain into the right position inside the connector 4.

Figure 5:
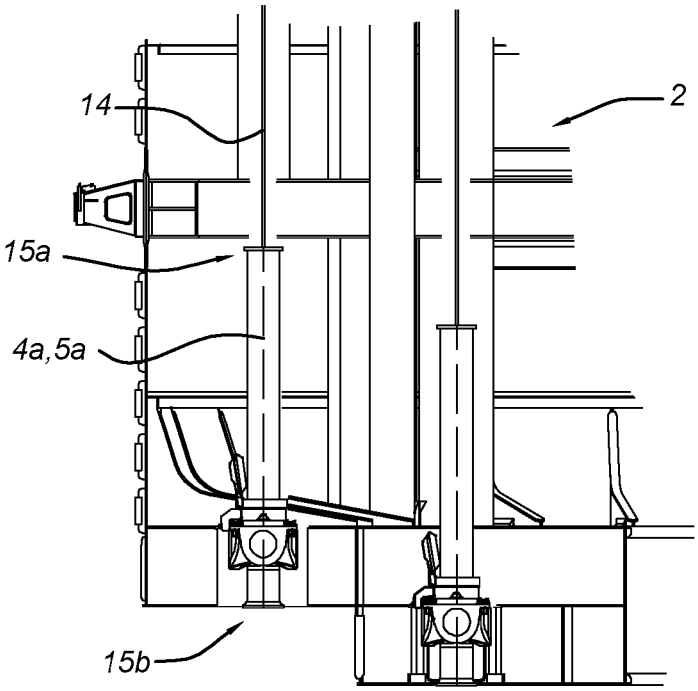
FIG. 5 shows a connector according to the invention, while a pick-up line has been connected.

FIG. 5 shows the connector 4 once the pick-up line 14 has been connected to the centering and stabilizing means 15. It appears clearly that the centering means 15*a* enables an optimum positioning of the line while pulling on it to retract the connector. The stabilizing means 15*b* can be of any type such as a clump weight. It needs to have a sufficient weight to lower the center of gravity for an enhanced retraction using a winch (not shown) installed on the vessel 1. The stabilizing means needs to have a volume sufficient to block the bottom part of the elongate element 5 in order to initiate the move of the latest when pulling further on the line 14.

Although particular embodiments of the invention have been described and illustrated herein, it is recognized that modifications and variations may readily occur to those skilled in the art, and consequently, it is intended that the claims be interpreted to cover such modifications and equivalents.

The invention claimed is:

1. A mooring leg connector for use with a mooring leg (3) that has an upper portion with an axis, where the mooring leg (3) extends up from the sea floor, to connect a floating body (1) to the seabed, said connector comprising:

a fixed part (20) that is fixed with regard to the floating body (1); and a movable part (30) which is movable with regard to the fixed part (20) from a first position to a second position, wherein the fixed part (20) comprises, a ratchet (6);

a double articulation assembly having two mutually perpendicular pivot axes (7, 8); and a housing (10).

2. A mooring leg connector according to claim 1 wherein the ratchet (6) is provided with a counterweight (11) to maintain the ratchet open when the connector (4) is not connected to a mooring leg (3).

3. A mooring leg connector according to claim 1 wherein the movable part (30) comprises an elongate tubular member (5) extending in the anchor line direction which is retractable with regard to the fixed part (20) from the first position where the housing (10) is located at the top of the elongate tubular member (5) to the second position where the housing (10) is located at the bottom of the elongate tubular member (5).

4. A mooring leg connector according claim 1 wherein the movable part (30) is provided with cathodic protections (13) against the corrosion, fitted inside the movable part (30) itself.

5. A mooring leg connector according to claim 1 wherein the ratchet (6) is provided with a counterweight (11) to maintain the ratchet open when the connector (4) is not connected to a mooring leg (3).

6. Offshore construction comprising a floating body (1), at least one anchor line (3) for connecting the floating body to the sea bed, the anchor line being connected to the floating body via a connector (4) according to claim 1.

7. A mooring leg connector for use with a mooring leg (3) that has an upper portion with an axis, where the mooring leg (3) extends up from the sea floor, to connect a floating body (1) to the seabed, said connector comprising:

a fixed part (20) that is fixed with regard to the floating body (1); and a movable part (30) which is movable with regard to the fixed part (20) from a first position to a second position, wherein the movable part (30) comprises an elongate tubular member (5) extending in an anchor line direction and which is retractable with regard to the fixed part (20)

from the first position where a housing (10) is located at the top of the elongate tubular member (5) to the second position where the housing (10) is located at the bottom of the elongate tubular member (5).

8. Offshore construction comprising a floating body (1), at least one anchor line (3) for connecting the floating body to the sea bed, the anchor line being connected to the floating body via a connector (4) according to claim 7.

9. Method to retract a mooring leg connector according to claim 7, the method comprising the steps of:

lowering a pick up line (14) through the connector elongate member (5);

picking up the line (14) with a ROV;

connecting the line (14) to a centering and stabilizing means (15);

pulling the pick-up line such that the centering and stabilizing means contacts the connector (4);

retract the movable part (30) of the connector by further pulling on the pick-up line (14).

10. A mooring leg connector according claim 7 wherein the movable part (30) is provided with cathodic protections (13) against the corrosion, fitted inside the movable part (30) itself.

11. A mooring leg connector for use with a mooring leg (3) that has an upper portion with an axis, where the mooring leg (3) extends up from the sea floor, to connect a floating body (1) to the seabed, said connector comprising:

a fixed part (20) that is fixed with regard to the floating body (1); and a movable part (30) which is movable with regard to the fixed part (20) from a first position to a second position, wherein the movable part (30) is provided with cathodic protections (13) against the corrosion, fitted inside the movable part (30) itself.

* * * * *